US010670380B2

(12) United States Patent
Guth

(10) Patent No.: US 10,670,380 B2
(45) Date of Patent: Jun. 2, 2020

(54) EXPLOSIVE SMOKE GRENADE

(71) Applicant: RHEINMETALL WAFFE MUNITION GMBH, Unterluess (DE)

(72) Inventor: Sven Guth, Neuenburg (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 0 days.

(21) Appl. No.: 15/854,373

(22) Filed: Dec. 26, 2017

(65) Prior Publication Data

US 2018/0209771 A1 Jul. 26, 2018

Related U.S. Application Data

(63) Continuation of application No. PCT/EP2016/062293, filed on May 31, 2016.

(30) Foreign Application Priority Data

Jun. 23, 2015 (DE) ..... 10 2015 110 061

(51) Int. Cl.
*F42B 12/48* (2006.01)
*F42B 12/70* (2006.01)
(Continued)

(52) U.S. Cl.
CPC ..... *F42B 12/48* (2013.01); *F41G 1/473* (2013.01); *F42B 12/70* (2013.01); *F42C 11/06* (2013.01);
(Continued)

(58) Field of Classification Search
CPC ..... F42B 12/20; F42B 12/42; F42B 12/44; F42B 12/48; F42B 12/70; F42B 30/04;
(Continued)

(56) References Cited

U.S. PATENT DOCUMENTS 4,838,167 A * 6/1989 Prahauser ..... F41J 2/02 102/334
4,860,657 A 8/1989 Steinicke et al.
(Continued)

FOREIGN PATENT DOCUMENTS

DE 4327976 C1 * 1/1995 ..... C06D 3/00
DE 102011107960 B3 3/2012
(Continued)

OTHER PUBLICATIONS

International Written Opinion in International Application No. PCT/EP2016/062293; dated Nov. 4, 2016.*
(Continued)

*Primary Examiner* — James S Bergin
(74) *Attorney, Agent, or Firm* — Muncy, Geissler, Olds & Lowe, P.C.

(57) ABSTRACT

In order to obtain an explosive smoke grenade, which can be fired from a portable anti-tank weapon, in particular a recoilless infantry weapon, and permits an enemy position or a vehicle to be fogged as quickly as possible, so that the enemy has only a very limited radius of action, a explosive smoke grenade is provided with a time fuse that can be programmed such that the burst charge detonates in the direct vicinity of the enemy position but before the grenade has reached the ground, and releases the smoke-generating active material. In addition, the pyrotechnic active substance arranged between the burst charge and the grenade casing is formed of a plurality of film strips, which are coated with a red-phosphorus-containing incendiary composition (flares). For this purpose, the dimensions of the flares are selected such that they generate a visibility barrier in both the visible and the infrared wavelength regions.

9 Claims, 3 Drawing Sheets

(51) Int. Cl.

| | |
|---|---|
| ***F42C 17/04*** | (2006.01) |
| ***F42C 11/06*** | (2006.01) |
| ***F41G 1/473*** | (2006.01) |
| *F41C 27/06* | (2006.01) |
| *F42B 12/20* | (2006.01) |
| *F42B 30/04* | (2006.01) |
| *F42C 9/02* | (2006.01) |

(52) U.S. Cl.
CPC ..... *F42C 11/065* (2013.01); *F42C 17/04* (2013.01); *F41C 27/06* (2013.01); *F42B 12/20* (2013.01); *F42B 30/04* (2013.01); *F42C 9/02* (2013.01)

(58) Field of Classification Search
CPC ..... F42C 9/02; F42C 11/06; F42C 11/065; F42C 17/04; F41C 27/06; F41G 1/473
USPC ..... 102/334
See application file for complete search history.

(56) References Cited

U.S. PATENT DOCUMENTS 5,499,582 A * 3/1996 Schiessl ..... F42B 4/06 102/285
5,635,666 A * 6/1997 Bannasch ..... C06D 3/00 102/292
5,835,051 A * 11/1998 Bannasch ..... F41H 9/00 342/12
6,513,438 B1 * 2/2003 Fegg ..... F41H 11/02 102/336
7,021,187 B1 4/2006 Grassi
7,903,019 B2 * 3/2011 Frick ..... F41H 11/02 244/117 R
2009/0007766 A1 1/2009 Turner, Jr.
2012/0175418 A1 7/2012 Jones

FOREIGN PATENT DOCUMENTS

DE 10 2012 014 149 B3 7/2013
DE 10 2012 010 378 A1 12/2013
DE 10 2012 014 150 A1 1/2014
EP 0805333 A2 11/1997

OTHER PUBLICATIONS

International Search Report and Written Opinion dated Nov. 4, 2016 in International Application No. PCT/EP2016/062293.

* cited by examiner

EXPLOSIVE SMOKE GRENADE

This nonprovisional application is a continuation of International Application No. PCT/EP2016/062293, which was filed on May 31, 2016, and which claims priority to German Patent Application No. 10 2015 110 061.4, which was filed in Germany on Jun. 23, 2015, and which are both herein incorporated by reference.

BACKGROUND OF THE INVENTION

Field of the Invention

The invention relates to an explosive smoke grenade that can be fired from a portable anti-tank weapon, in particular a recoilless infantry weapon.

Description of the Background Art

Explosive smoke grenades essentially consist in each case of a grenade casing with a central bursting charge (explosive charge), extending in the direction of the longitudinal axis of the grenade, and also a smoke-producing pyrotechnic active compound, enclosing the bursting charge. The known smoke grenades generally have on the front side an impact detonator, which when the grenade hits the target area ignites the bursting charge and releases the pyrotechnic active compound, which for example includes white phosphorus (cf. for example: Rheinmetall "Waffentechnisches Taschenbuch" [pocketbook of weapons], 7th edition 1985, page 491).

It is also known that smoke grenades can be fired by means of portable anti-tank weapons, for example anti-tank rocket launchers. For instance, it is specified in the Internet article "FFV Carl Gustaf" (http://de.wikipedia.org/wiki/FFV_Carl_Gustaf), retrieved on May 2, 2012, that smoke grenades are also available for the FFV Carl Gustav reactive rocket propelled grenade. However, the construction of such a smoke grenade is not known from the published prior art.

Among the problems when using explosive smoke grenades that can be fired from portable anti-tank weapons is that the amount of smoke-producing active compound required to provide a visual barrier in both the visible and the infrared wavelength range is relatively small. It is also generally not possible with such weapons to deliver a number of grenades into the target area at the same time in order to provide a smoke screen over a relatively great target area.

SUMMARY OF THE INVENTION

It is therefore an object of the present invention to provide an explosive smoke grenade that can be fired from a portable anti-tank weapon and makes it possible to shroud an enemy position or enemy vehicle in smoke as quickly as possible and over as great an area as possible.

This object is achieved according to the invention by the features of claim 1. Further, particularly advantageous refinements of the invention are disclosed by the subclaims.

DE 10 2012 010 378 A1, which is incorporated herein by reference, discloses a munition with active bodies that are initiated and expelled at the same time and/or with a time delay. The setting is performed by using so-called delay compositions. The different delay times can for their part be implemented in different delay elements. A pressure-controlled delay element is described in DE 10 2012 014 150 A1, which is incorporated herein by reference, and a mechanically adjustable delay element is described in DE 10 2012 014 149 B3, which is incorporated herein by reference.

In an embodiment, the present invention is essentially based on the idea of providing the explosive smoke grenade with a delayed-action detonator instead of an impact detonator. This delayed-action detonator can be programmed in such a way that the bursting charge is ignited in the direct vicinity of the enemy position, but before the grenade has reached the ground, and releases the smoke-producing active compound there. A range finder that is preferably integrated in the weapon determines the distance from the target. The target is for example aimed at manually and the range finder, for example a laser, is preferably activated manually. Alternatives are familiar to a person skilled in the art. This measured value is then processed in the electronics of the detonator and defines the run time to bursting (airburst). By igniting the smoke-producing compound, about 6-8 m above the ground, a relatively extensive wall of smoke (visual barrier) is produced very quickly between the shooter and the target. The pyrotechnic active compound is formed by flares, which consist of a multiplicity of film strips.

The pyrotechnic active compound can be arranged between the bursting charge and a grenade casing. The film strips are respectively coated with an incendiary composition, which in particular contains red phosphorus (RP). The active compound is preferably made up of red phosphorus, potassium nitrate and a binder. The dimensions of the flares and the coating thicknesses of the corresponding incendiary compositions are chosen in this case in such a way that the smoke produced by the active compound brings about a visual barrier in both the visible and the infrared wavelength range. The dimensions of the flares are freely selectable and can be adapted for each caliber. The layer thicknesses of the incendiary composition coatings containing the red phosphorus should preferably lie between 400 μm and 800 μm. Preferably serving as the carrier material are films of plastic. The grenade casing preferably consists of plastic or a thin-walled aluminum sheet.

The bursting charge can be arranged inside a screen tube of a metallic material that is surrounded by the flares, since the screen tube is not intended to be fragmented. The screen tube defines a uniform ignition of the flares. The wall thickness of the screen tube should be designed in accordance with the detonation loading that the screen tube has to withstand.

The wall of smoke can be further optimized by the flares that are used having different coating thicknesses of the incendiary composition. As a result, a homogeneous wall of smoke is produced. The thinner-coated flares can burn away almost completely in the air on account of their low weight, and the accompanying low falling rate. As a result, the thicker flares, coated with the incendiary composition, have a greater falling rate and fall faster to the ground. These then also produce smoke from the ground.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
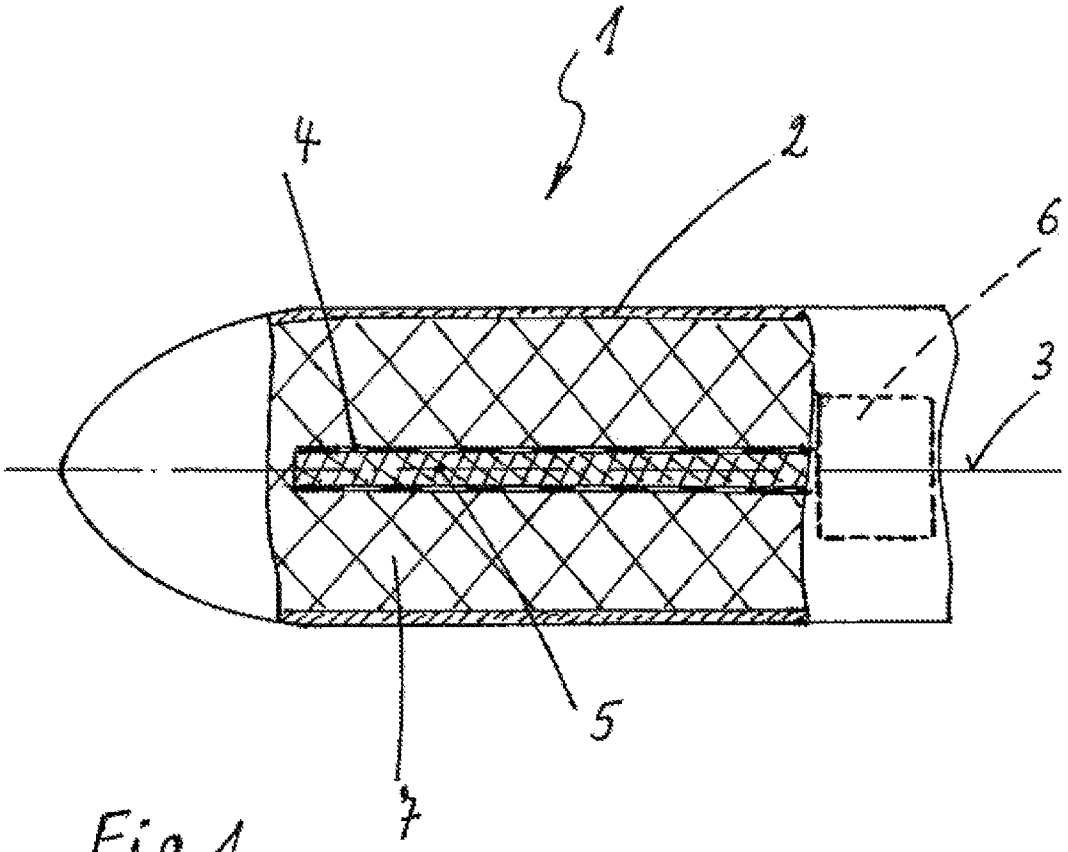
FIG. 1 shows a longitudinal section through the submunition of a schematically represented explosive grenade according to the invention.

In FIG. 1, the submunition of an explosive smoke grenade that can be fired from an anti-tank rocket launcher is denoted by 1. The explosive smoke grenade 1 comprises a preferably fragmentable grenade casing 2, in the ideal case of plastic or thin-walled aluminum, with a screen tube 4 which extends in the direction of the longitudinal axis 3 of the explosive smoke grenade 1 and in which there is a bursting charge 5. For this purpose, the grenade casing 2 preferably has predetermined breaking points or the like (not represented any more specifically).

At the rear, a programmable delayed-action detonator 6 is arranged behind the bursting charge 5.

Between the bursting charge 5 and the grenade casing 2 there is a smoke-producing pyrotechnic active compound 7. This consists of a multiplicity of film strips 11, which are respectively coated with an incendiary composition 12 that contains red phosphorus (flares) and are preferably arranged radially around the bursting charge 5, i.e. the screen tube 4 (with holes).

The flares of the active compound 7 have different coating thicknesses of the incendiary composition, the coating thicknesses preferably lying between 400 μm and 800 μm.

Figure 2:
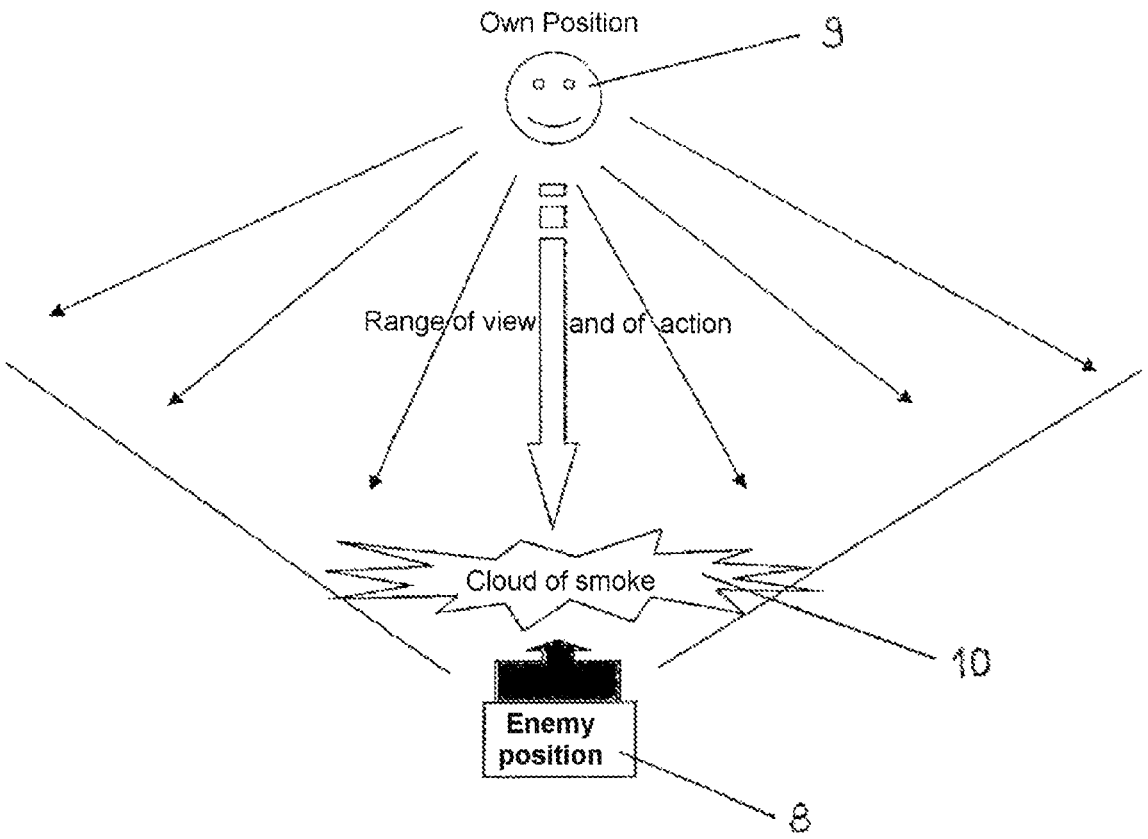
FIG. 2 shows a schematic view of the use of such an explosive grenade.
Figure 3:
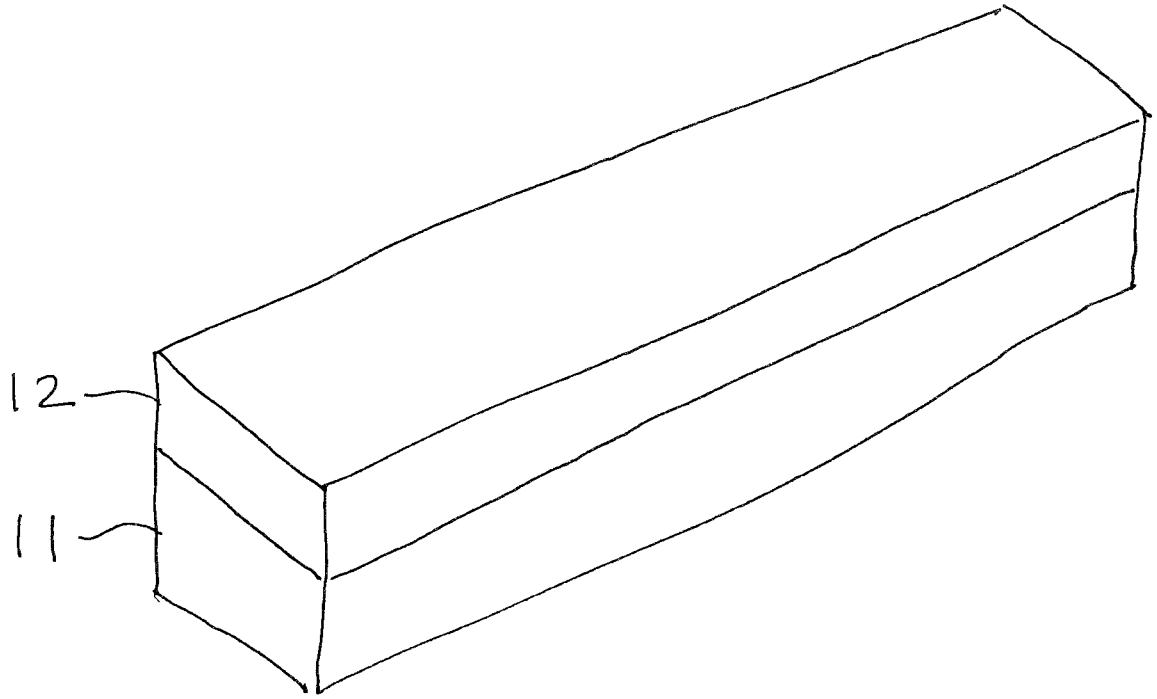
FIG. 3 shows a film strip.

The operating mode of the explosive smoke grenade 1 is discussed below with the aid of FIG. 2:

In order for example to surround an enemy position 8 or undertake a change of position, the corresponding shooter first determines from his own position 9 the distance from the enemy position 8 of the enemy with the aid of a range finder (for example a weapon sight). Subsequently, the shooter then determines the distance at which the delayed-action detonator 6 of the explosive smoke grenade 1 is to be ignited. This ignition time should generally be a few meters from the target and approximately 6-8 m above the ground. If the anti-tank rocket launcher has a firing control computer, the programming can be performed by this computer. Subsequently, the delayed-action detonator 6 of the explosive smoke grenade 1 is programmed correspondingly, the directing angle is determined and the weapon is directed.

After firing the explosive smoke grenade 1, the bursting or activation is performed by the delayed-action detonator 6 in a way corresponding to the time setting of the delayed-action detonator 6, whereby the flares are ignited and distributed. The fragmentable projectile casing 2 is fragmented into small pieces, while the flares fall burning to the ground and form a wall of smoke and an infrared shield. In this case, the dimensions of the flares are chosen such that they produce a visual barrier in both the visible and the infrared wavelength range. The flares preferably have different layer visibility thicknesses, which allow a homogeneous wall (wall of smoke 10) to be produced. The thinner-coated flares burn away almost completely in the air and fall more slowly to the ground than the thicker-coated flares. These fall more quickly to the ground because of their associated heavier dead weight, and at the same time still produce smoke before they reach the ground. This combination of differently coated flares provides an optimum wall of smoke 10 and shield, since the thinner-coated flares form the upper region of the wall of smoke 10 and the heavier flares form the lower region (near the ground) of the wall of smoke 10. After or during the production of the cloud of smoke 10, it is then possible for example for the desired change of position to be carried out.

As already mentioned, the explosive smoke grenade 1 can be fired or launched from a portable anti-tank weapon, in particular a recoilless infantry weapon.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An explosive smoke grenade comprising:

a grenade casing with a central bursting charge extending in a direction of a longitudinal axis of the explosive smoke grenade;

a settable delayed-action detonator for activating the central bursting charge; and a smoke-producing pyrotechnic active compound arranged between the bursting charge and the grenade casing, the smoke-producing pyrotechnic active compound comprising a plurality of film strips that are respectively coated with an incendiary composition that contains red phosphorus, wherein the plurality of film strips form flares, and wherein the flares have different predetermined coating thicknesses of the incendiary composition, such that some of the flares have a thinner coating thickness than other flares.

2. The explosive smoke grenade as claimed in claim 1, wherein each of the predetermined coating thicknesses lie between 400 μm and 800 μm.

3. The explosive smoke grenade as claimed in claim 1, wherein the grenade casing is formed of plastic or an aluminum sheet.

4. The explosive smoke grenade as claimed in claim 1, wherein the bursting charge is arranged inside a screen tube that is surrounded by the flares of the active compound.

5. The explosive smoke grenade as claimed in claim 4, wherein the screen tube is formed of metallic material.

6. The explosive smoke grenade as claimed in claim 1, wherein the grenade casing is fragmentable and has predetermined breaking points.

7. The explosive smoke grenade as claimed in claim 1, wherein the plurality of film strips are formed of plastic.

8. The explosive smoke grenade as claimed in claim 1, wherein the incendiary composition consists of red phosphorus, potassium nitrate and a binder.

9. The explosive smoke grenade as claimed in claim 1, wherein dimensions of the flares are selected such that the flares produce a visual barrier in a visible range and in an infrared wavelength range.

* * * * *